US007690114B2

(12) United States Patent
Büerger et al.

(10) Patent No.: US 7,690,114 B2
(45) Date of Patent: Apr. 6, 2010

(54) TUBE HAVING REINFORCING STRUCTURES MADE OF PROFILE ROLLED METAL AND METHOD OF PRODUCING SAME

(75) Inventors: Achim Büerger, Hoehr-Grenzhausen (DE); Adrianus Jacobus Wittebrood, Velserbroek (NL); Nicole Cornelia Maria Agatha Smits, Haarlem (NL)

(73) Assignee: Aleris Aluminum Koblenz GmbH, Koblenz (DE)

( * ) Notice: Subject to any disclaimer, the term of this patent is extended or adjusted under 35 U.S.C. 154(b) by 1219 days.

(21) Appl. No.: 11/242,124

(22) Filed: Oct. 4, 2005

(65) Prior Publication Data

US 2006/0112557 A1 Jun. 1, 2006

(30) Foreign Application Priority Data

Oct. 22, 2004 (EP) ..... 04077907

(51) Int. Cl.
*B23P 15/26* (2006.01)

(52) U.S. Cl. ..... 29/890.049; 29/890.03; 29/890.038; 29/890.039; 29/890.045; 29/890.046; 29/890.053; 165/152; 165/177; 165/183

(58) Field of Classification Search ..... 29/890.03, 29/890.038, 890.039, 890.045, 890.053, 29/890.049; 165/152, 177, 183
See application file for complete search history.

(56) References Cited

U.S. PATENT DOCUMENTS

| | | | | |
|---|---|---|---|---|
| 5,186,250 | A | 2/1993 | Ouchi et al. | |
| 5,931,226 | A | 8/1999 | Hirano et al. | |
| 5,947,365 | A | 9/1999 | Tanaka et al. | |
| 6,209,202 | B1 | 4/2001 | Rhodes | |
| 6,379,818 | B1 | 4/2002 | Mooij et al. | |
| 6,391,476 | B2 | 5/2002 | Wittebrood | |
| 6,753,094 | B1 | 6/2004 | Wittebrood | |
| 7,341,099 | B2 * | 3/2008 | Kaimura et al. | 165/152 |
| 2004/0244196 | A1 | 12/2004 | Kaimura et al. | |

FOREIGN PATENT DOCUMENTS

| | | |
|---|---|---|
| DE | 19518657 | 10/1996 |
| DE | 19518657 A1 | 10/1996 |
| EP | 1074807 | 2/2001 |
| JP | 56071520 | 6/1981 |
| JP | 2000074586 | 3/2000 |
| JP | 00346576 | 12/2000 |
| JP | 02228369 | 8/2002 |
| WO | 9634245 A1 | 10/1996 |
| WO | 02100567 | 12/2002 |

* cited by examiner

*Primary Examiner*—Rick K Chang
(74) *Attorney, Agent, or Firm*—Novak Druce + Quigg LLP

(57) ABSTRACT

Disclosed is a tube made of a profile rolled metal product, in particular for use in heat exchangers, a rolled metal product and a method of producing the same. The tube includes a first wall and a second wall forming two opposing sides of the tube, and a plurality of reinforcing structures connecting the first and second walls and forming longitudinal passages between them. Each reinforcing structure is formed by a longitudinal ridge on the first wall projecting towards the second wall and a longitudinal ridge on the second wall protecting towards the first wall. The ridges are joined to each other at their sides.

22 Claims, 5 Drawing Sheets

TUBE HAVING REINFORCING STRUCTURES MADE OF PROFILE ROLLED METAL AND METHOD OF PRODUCING SAME

CROSS-REFERENCE TO RELATED APPLICATIONS

This claims priority from European patent application No. 04077907.6 filed Oct. 22, 2004 incorporated herein by reference in its entirety.

FIELD OF THE INVENTION

The invention relates to a tube made of a profile rolled metal product, in particular for use in heat exchangers, a rolled metal product and a method for producing the same. In particular, the invention is directed to a tube including a plurality of reinforcing structures forming longitudinal passages for transporting fluid, e.g. a refrigerant, between them.

BACKGROUND OF THE INVENTION

Heat exchanges such as condensers, evaporators and the like for use in car coolers, air conditioning systems etc. usually comprise a number of heat exchange tubes arranged in parallel between two headers, each tube joined at either end to one of the headers. Corrugated fins are disposed in an airflow clearance between adjacent heat exchange tubes and are brazed to the respective tubes. The heat exchanger is typically made of aluminium or an aluminium alloy.

In the past, flat refrigerant tubes have been manufactured by folding a brazing sheet clad on the outside with a brazing material layer. The refrigerant tubes, the headers and the fins, were then assembled and heated to the brazing temperature at which the clad layer melts and joins together the fins, refrigerant tubes and headers into a brazed assembly.

It is envisaged gases such as carbon dioxide will be used as cooling medium in air-conditioning systems. The use of carbon dioxide will lead to an increase in operating temperature and pressure of the air-conditioning units. The above described conventional brazed tubes might not withstand under all circumstances the encountered operating pressures and temperatures. For the existing carbon dioxide based prototypes, the heat exchange tubes have therefore been made of a hollow extrusion comprising flat upper and lower walls and a number of reinforcing walls connecting the upper and lower walls. A disadvantage of the extrusion technique is that the walls cannot be made as thin as desired. Further, an extruded tube cannot be clad with brazing material, so the corrugated fins must be clad in order to allow brazing to the heat exchange tubes, which is expensive due to the large surface area of the fins. In addition, a tube made of brazed sheet or plate is stronger and more resistant against corrosion than extruded tubes.

U.S. Pat. No. 5,931,226 discloses a refrigerant tube or fluid tube for use in heat exchangers comprising a flat tube having upper and lower walls and a plurality of longitudinal reinforcing walls connected between the upper and lower walls. The reinforcing walls consist of ridges projecting inward from the upper or lower wall and are joined to the flat inner surface of the other wall. The ridges are produced by rolling an aluminium sheet clad with a brazing filler metal layer over at least one of its opposite surfaces with a roll having parallel annular grooves. Parallel refrigerant or fluid passages are defined between adjacent reinforcing walls. Further, the reinforcing walls include a plurality of communication holes for causing the parallel refrigerant passages to communicate with one another. In another embodiment, each reinforcing wall is formed by a ridge projecting from the upper wall and a ridge protecting from the lower wall, joined to each other at their respective top ends. The upper and lower walls are either produced separately or in one sheet, whereby the flat refrigerant tube is manufactured by folding the sheet longitudinally at its midpoint like a hairpin.

U.S. Pat. No. 5,947,365 describes a process for producing a similar flat heat exchange tube having a plurality of reinforcing walls formed of ridges projecting from the lower wall. The upper and lower walls are connected by brazing the tops of the ridges on the lower wall to the upper wall. In order to strengthen the brazed connection between the reinforcing walls and the lower surface of the upper wall and to prevent the creation of a clearance space therebetween, the lower surface of the upper wall is provided with smaller longitudinal ridges with which the upper surfaces of the reinforcing walls come into contact to eliminate the clearances and thereby to insure the existence of a continuous brazed connection between each reinforcing wall and lower surface of the upper wall.

A different method of producing reinforcing walls in a flat refrigerant tube for use in heat exchangers is shown in U.S. Pat. No. 5,186,250. The tube comprises one or more curved lugs integral with and protruding inwardly from an inner surface of each plane wall, and the curved lugs respectively have innermost tops so that the innermost tops protruding from one plane wall bear against the inner surface of the other plane wall or against the tops of the other curved lugs protruding from the opposite plane wall. The purpose of such protruding lugs is said to improve the pressure resistance of the tube while minimizing its height and thickness.

In the production of these known tubes, it is difficult to achieve a precise alignment between the ridges on the upper and lower walls, especially in those embodiments where two ridges protruding from opposing walls have to be joined head-on. Further, the brazed connection between the ridges or between the top of a ridge and the lower surface of the opposing wall is not very strong.

SUMMARY OF THE INVENTION

It is a preferred object of the present invention to provide a tube made of a profile rolled metal product, in particular for use in heat exchangers, made of a profile rolled metal product, the tube comprising a first wall and a second wall forming two opposing walls of said tube, and a plurality of reinforcing structures connecting the first and second walls and forming longitudinal passages for transporting fluid between the first and the second wall, and having an improved strength and pressure resistance.

It is further an object of the invention to provide a relative simple method of producing such a profile rolled tube.

The invention meets one or more of these objects by providing a tube made of a profile rolled metal product according to the independent claims. Preferred embodiments are described and specified by this specification.

BRIEF DESCRIPTION OF THE DRAWINGS

The following is a brief description of the appended drawings.

DETAILED DESCRIPTION OF THE PREFERRED EMBODIMENTS

Figure 1:
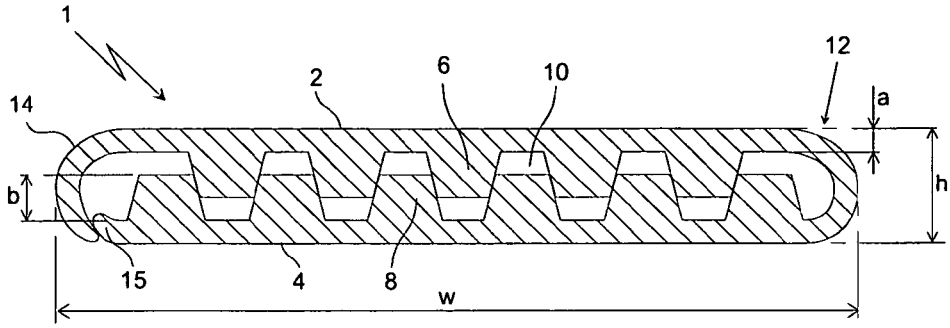
FIG. 1 shows a schematic cross-sectional view of a tube according to a first embodiment of the invention.

As will be appreciated herein below, except otherwise indicated, all alloy designations and temper designations refer to the Aluminum Association designations in Aluminium Standards and Data and the Registration Records, as published by the Aluminium Association.

In its apparatus respects the present invention relates to a tube made of a profile rolled metal product, in particular for use in heat exchangers includes a first wall and a second wall forming two opposing sides of the tube, and a plurality of reinforcing structures connecting the first and the second walls and forming longitudinal passages for transporting fluid (also referred to as fluid passages) between them. Each reinforcing structure compromises a longitudinal ridge on the first wall projecting towards the second wall and a longitudinal ridge on the second wall projecting towards the first wall, the ridges engaging each other at theirs sides. The sideways engagement of the ridges has one or more of the following advantages. First, it gives a more stable and pressure resistant junction between the first and the second wall because the areas joined together may be made relatively large. Further, the joint is subjected to shear forces rather than traction forces when the pressure inside the tube increases. In addition, the positioning of the first and second walls on top of each other is facilitated if the ridges engage each others sideways. Hence, the ridges might serve as a positioning aid directing the walls to the desired position with respect to one another.

There are several preferred embodiments of the profile geometry of the first and second walls. Preferably the ridges disposed on the first or second walls are broader at the base than at the top, though most embodiments will work with a rectangular profile, or a cone-shaped profile too. At present, a trapezoidal cross-section is most preferred.

In a preferred embodiment, the first wall has the same profile, i.e. the same ridge geometry as the second wall. This has the additional advantage that the fluid tube may be produced by folding a single sheet.

It has been found advantageous to provide the ridges with cut-outs forming communication holes or passages for causing adjacent fluid passages to communicate with one another. Thus, the ridges are not continuous over the entire length of a tube, but have gaps spaced from one another, forming the holes. Such holes are believed to cause turbulence in the refrigerant flow and thus promote the heat exchange between the tube walls and the refrigerant flowing through the tube.

In a particularly preferred embodiment, both walls have a profile of ridges which are broader at the base than at the top and spaced from one another such that a groove is formed between two neighbouring ridges, wherein the two sides of a ridge engage the two sides of a groove in the opposing wall, thereby forming a longitudinal passage in the groove. This embodiment has particularly high strength, because each ridge may be connected to another ridge on either side. When assembling the two walls, the ridges on either wall will interdigitate and thereby exactly fit into one another. Therefore, this design is particularly easy to assemble. The same applies for the cone-shaped profiles mutatis mutandis.

According to the second embodiment, each ridge on one wall is joined to a ridge on the opposing wall on one side, forming a refrigerant passage on its other side. This profile will leave more open space between the ridges. If the profile is modified such that the top of each ridge in one wall engages a recess in the other wall, the two walls will form fit with each other. When assembling the tube, the two walls will effectively click into each other.

The third embodiment provides a different profile for each wall. The second wall has a profile of ridges forming grooves between two neighbouring ridges, wherein each ridge on the first wall engages a groove in the second wall. Thus, the two walls will also fit into each other.

According to a fourth embodiment, the first wall has a profile of main ridges having small ridges on top. The small ridges are joined to the sides of corresponding small ridges in the second wall.

The ridges of the first and second walls are preferably joined to each other by one or more of friction welding, resistance welding or brazing, or by a combination of welding and brazing.

In a further aspect of the invention it provides a rolled metal product for producing the first and/or the second wall of the above described tubes. Thus, the rolled metal product has a profile as described above and is produced by rolling a brazing sheet clad at least on one side with a brazing material.

In another aspect of the invention there is provided a method for producing a tube according to this invention, the method comprising the steps of:

- producing the first and the second wall by rolling a metal sheet clad at least on one side with a brazing material with a pair of rolls, one of the rolls having parallel annular grooves for forming ridges on one side of the sheet,
- placing the first wall on top of the second wall,
- connecting the first and second walls by clamping or rolling.

One of the problems encountered in producing heat exchangers using the tube according to the invention is to hold the first and second walls together, while assembling all components of the heat exchanger for subsequent brazing. If the first and second walls are not held together properly, a gap might open at the side or between the opposing ridges, resulting in a leaking tube and rejection of the heat exchanger as a whole. The method therefore provides a preliminary connection of the two walls which may be achieved by clamping or rolling.

According to an embodiment, the first and second walls are clamped together by flanging the sides. One edge of a longitudinal wall is for example bent to a U-shape holding the second wall. According to a preferred embodiment, the first and second walls are joined together by rolling. Such rolling may either cause a frictional connection between the first and second walls or a friction weld between the sides of the ridges engaging each other. Such a connection may occur, for example, when the interdigitating trapezoidal ridges of the first embodiment are pressed into one another.

In another aspect the invention relates to a method of producing a heat exchanger, the heat exchanger comprising a pair of headers, a plurality of refrigerant tubes joined at each end to one of the headers, and corrugated fins disposed between adjacent refrigerant tubes, and the method comprising the steps of producing the refrigerant tubes according to the method set out above, assembling the headers, the refrigerant tubes, and the corrugated fins, brazing the heat exchanger assembly.

Preferably, the tubes are made from a metal sheet, typically of an aluminium alloy, clad on one or both sides with a brazing material. If the insides of the refrigerant tubes are clad with the brazing material, the sides of the profiled ridges engaging each other are brazed together during brazing of the heat exchanger assembly. The clad layer on the outside serves to braze the corrugated fins to the heat exchanger tubes.

The above-mentioned and further features and advantages of the invention will become apparent from the following detailed descriptions of preferred embodiments with reference to the appended drawings.

A schematic cross-sectional view of a refrigerant tube according to a first embodiment of the invention is shown in FIG. 1. The tube is substantially flat and having a width w of up to 100 mm and typically about 15 to 50 mm, and a height h of up to 10 mm and typically about 0.5 to 5 mm. The prior art tubes made of non-profiled aluminium sheets have wall thicknesses of 0.25 to 0.4 mm, but the tube having reinforcing walls according to the invention may have thinner walls while retaining the same stability and pressure resistance, for example a=0.1 to 0.3 mm, preferably 0.15 to 0.25 mm.

The tube is made from upper wall 2 and lower wall 4 produced by folding a rolled metal sheet longitudinally like a hair pin. The fold is indicated at 12. On the other side, upper and lower wall are held together by flange 14 which ends in this example around a ledge 15 on the lower wall and thereby produces a mechanical fixation of upper and lower wall with respect to one another. Both upper and lower walls display the same profile of trapezoidal ridges 6, 8 which interdigitate while leaving open spaces 10 as fluid passages. The fluid passages are preferably up to about 0.5 mm high.

Figure 2:
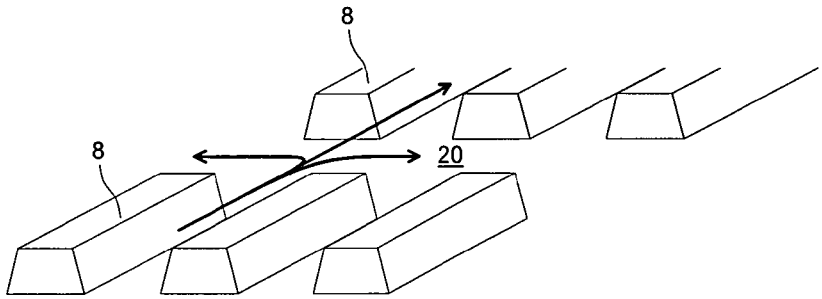
FIG. 2 shows a schematic perspective view of the lower wall of the embodiment of FIG. 1.

The ridges 6, 8 need not be continuous over the whole length of the tube, but may be interrupted by gaps or cut-outs 20 forming communication holes between adjacent fluid passages 10. The arrows in FIG. 2 indicate the direction of flow which is diverted from the leftmost passage to the adjacent passages. The cut-outs 20 may be disposed at the same longitudinal position for each ridge 8, or may be distributed along the length of the tube. In either case, the communication holes provide improved convention or turbulence of the cooling fluid between the different passages and as a resultant more heat transfer.

Figure 3:
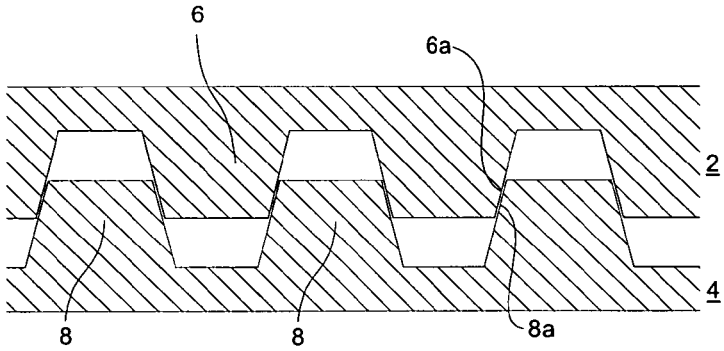
FIG. 3 shows enlarged schematic cross-sectional view of the profile according to the first embodiment.

FIGS. 3 to 9 illustrate different ridge profile geometries according to the above-mentioned embodiments of the invention. FIG. 3 shows the same geometry as FIG. 1, i.e. both walls having the same profile of trapezoidal ridges 6, 8, each ridge 6 engaging the sides of two adjacent ridges 8 on the opposite wall. A connection between the contacting sides 6*a* and 8*a* may be achieved by pressing the walls 2 and 4 together to achieve either a frictional engagement between the opposing ridges, or even a friction welded connection. The pressure may be exerted by passing the folded tube between two suitably adjusted rolls. In addition, the connection may be achieved by brazing which will be described in more detail below.

Figure 4:
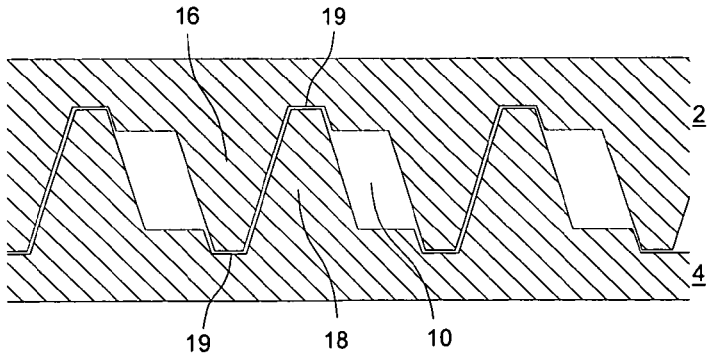
FIGS. 4 to 8 show enlarged schematic cross-sectional views of profiles according to further embodiments of the invention.
Figure 5:
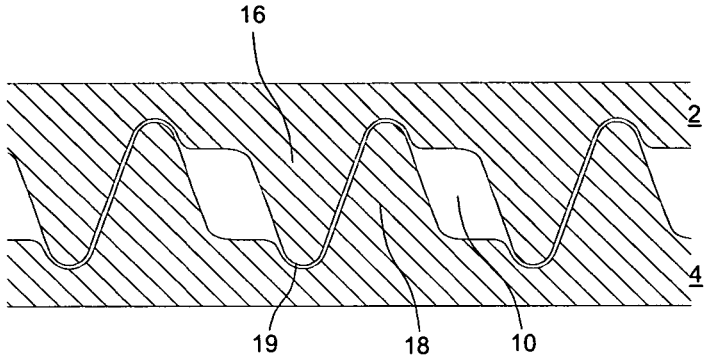

FIG. 4 and FIG. 5 display ridge geometries in which two ridges 16, 18 on the first and second walls only engage each other on one side, while a refrigerant passage 10 is formed on the other side. This design allows for a larger cross-section of the fluid passages 10. To improve the stability further, each ridge 16, 18 engages a corresponding groove 19 in the opposing wall. This embodiment may be designed either with trapezoidal ridges as in FIG. 4 or with ridges having rounded edges as in FIG. 5.

Figure 6:
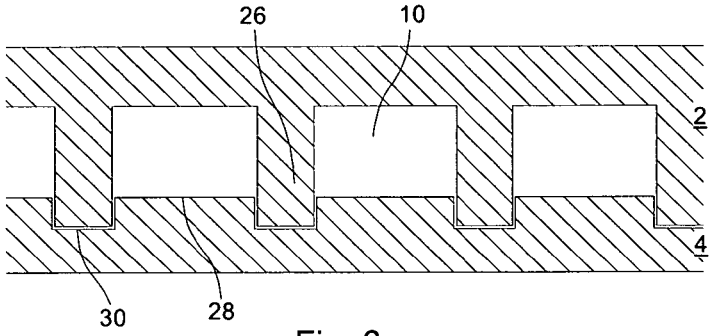

The third embodiment is shown in FIG. 6 using rectangular ridge profiles, but it may be embodied with trapezoidal profiles, too. The embodiment of FIG. 6 uses different profiles for upper and lower walls. Therefore, it might be preferable to construct a fluid tube with this design from two separate sheets rather than from one sheet folded at midpoint. The sheets could be rolled with the same roll but at different reductions. In detail, the upper wall has relatively high ridges 26, each engaging a shallow groove 30 formed between a couple of low ridges 28 on the lower wall.

Figure 7:
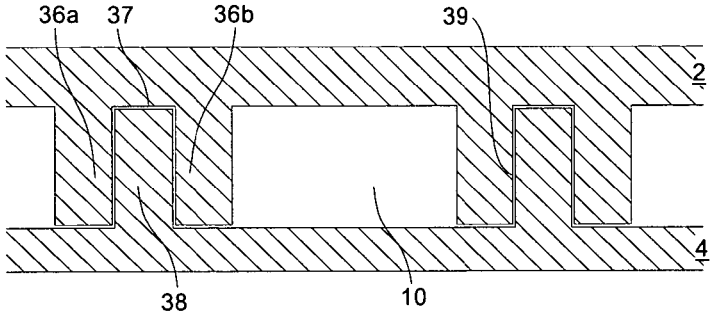

A variant of the third embodiment is shown in FIG. 7. In this design, a rectangular or otherwise shaped ridge 38 on the lower wall 4 engages a groove 37 formed between a couple of ridges 36*a*, 36*b*, formed in the upper wall 2. In contrast to FIG. 6, the ridges 36*a*, 36*b* reach as far as the lower wall and a refrigerant passage 10 is formed on the outer sides of ridges 36*a*, 36*b*. Since the contact surface 39 between ridges 36 and 38 is particularly large in this embodiment, the strength of the connection between upper and lower walls is excellent.

Figure 9A:
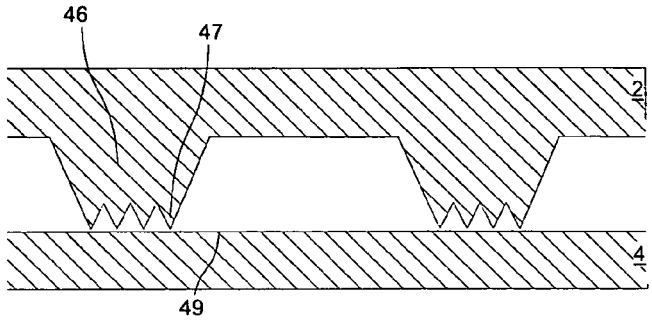
FIG. 9*a* and FIG. 9*b* show an enlarged schematic sectional view of a ridge profile according to another embodiment of the invention before (FIG. 9*a*) and after (FIG. 9*b*) rolling of the tubes.
Figure 9B:
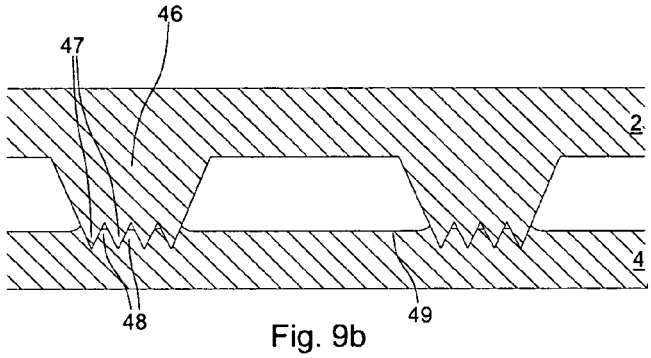

The fourth embodiment shown in FIGS. 9*a* and 9*b* is particularly suited for a frictional or friction welded connection between the upper and lower wall achieved by rolling. FIG. 9*a* shows the profile before rolling, and FIG. 9*b* shows the profile after rolling. As shown in FIG. 9*a*, the upper wall 2 is provided with main ridges 46 each having a flat top structured in small ridges 47 and engaging the flat inner surface of the lower wall 4. When upper and lower walls are pressed together by rolling, the small ridges 47 are pressed into the inner surface of the lower wall and thus form corresponding small ridges 48 in the lower wall. This will result in a frictional connection or a friction welded connection between upper and lower walls. This connection may either be the only connection of the tube, or may be combined with brazing.

Figure 8:
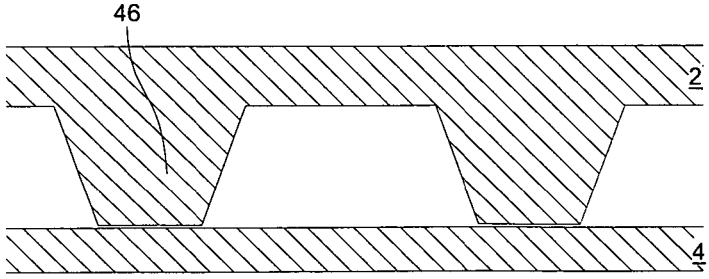

A variant of the fourth embodiment is shown in FIG. 8. In this design, trapezoidal ridges 46 on the upper wall engage the flat inner surface of the lower wall 4.

All embodiments of the profiles may be produced by rolling a metal sheet or plate, preferably an aluminium alloy sheet. The sheet may either be blank, or may be clad on one or both sides with a brazing filler material. The clad layer will preferably have a thickness of 2 to 13% of the total thickness of the brazing sheet. The choice of brazing material will depend on the chosen method of "preliminary" connection of the tube walls, and on the selected brazing technique, as described below. To achieve a brazing connection between upper and lower walls, one may use a double clad sheet for one wall and a single clad sheet for the other.

Figure 10:
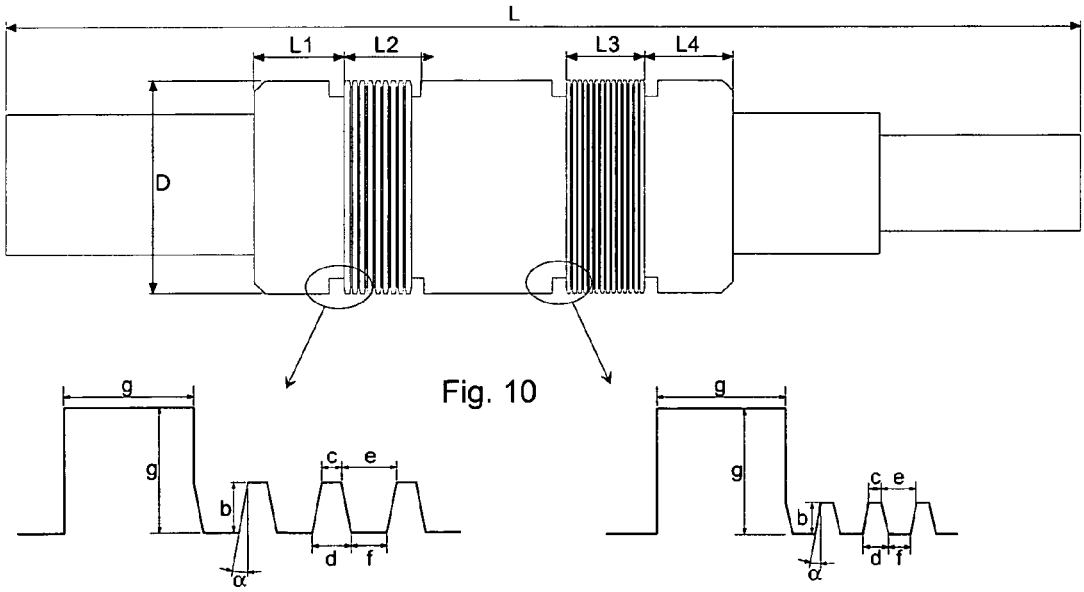
FIG. 10 shows a side view of a profile formed roll used to produce the profiled brazing sheets of the examples.

Representative examples of the above-shown profiles have been produced with the profile formed roll shown in FIG. 10. The length L was 405 mm, the diameter D was 79.66 mm, and the lengths L1 to L4 of the roll profile were 15 mm, 20.4 mm, 20.8 mm and 15 mm, respectively. The sections L2 and L3 of the roll are provided with 18 and 28 parallel annular grooves, respectively, the detailed profiles of which are shown in the lower part of the drawing.

The left profile consisted of trapezoidal grooves of depth b=0.8 mm, width at base f=0.55 mm and width at top e=0.85 mm. The sides were tilted at an angle of $\alpha$=11.8° with respect to the vertical. The distance between adjacent grooves was c=0.3 mm at the top and d=0.6 mm at the bottom.

Figure 11:
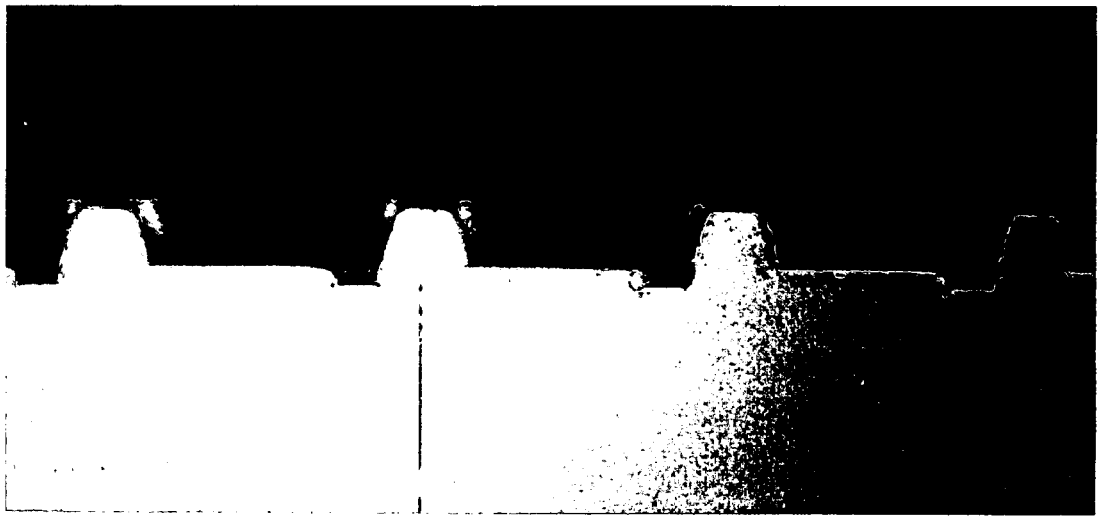
FIG. 11 shows an enlarged photograph of the roll surface.

The smaller profile shown on the right had grooves of a depth b=0.5 mm. The sides of the grooves were tilted $\alpha$=12.5° with respect to the vertical, and the grooves had a bottom width of f=0.35 mm and top width e=0.55 mm. The distance between adjacent grooves was c=0.2 mm at the top and d=0.4 mm at the bottom. The length g was 2 mm. A photograph of the left profile is shown in FIG. 11.

Figure 12:
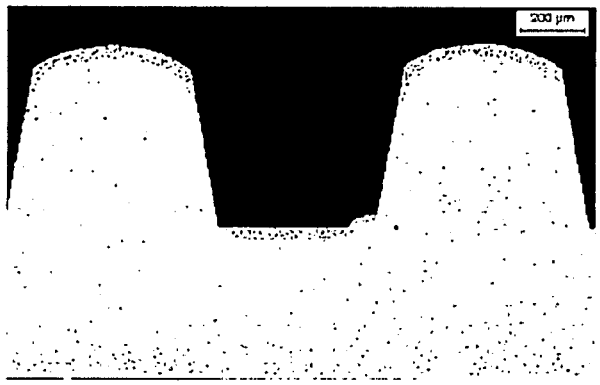
FIG. 12 shows an enlarged cut image of a brazing sheet after rolling according to the first embodiment.

This roll was used to roll an aluminium brazing sheet having a 5% clad layer of brazing material. The aluminium core was made of an AA3003 aluminium alloy according to the classification of the Aluminium Association, and the clad layer was made of an AA4004 aluminium alloy. The result is shown in FIG. 12. As is apparent from the figure, the roll produced an almost perfect trapezoidal profile of ridges. The clad layer accumulated mainly on the top of the ridges and the bottom of the grooves.

Figure 13:
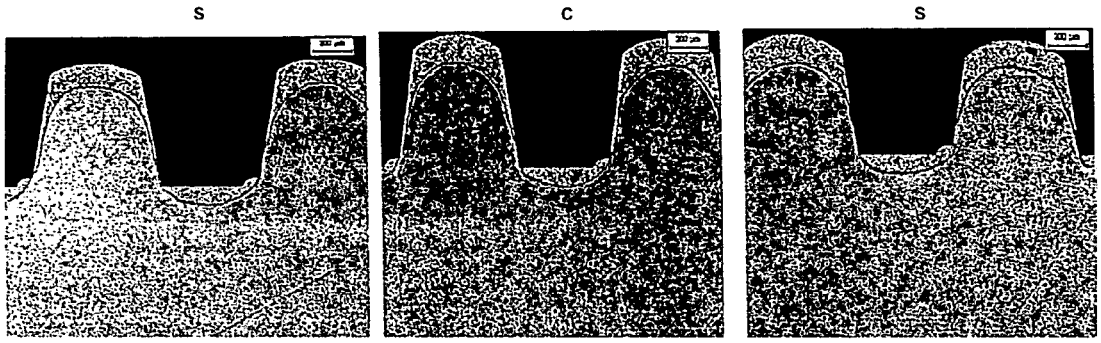
FIG. 13 shows polished cut images of a brazing sheet after rolling according to the second embodiment.
Figure 14:
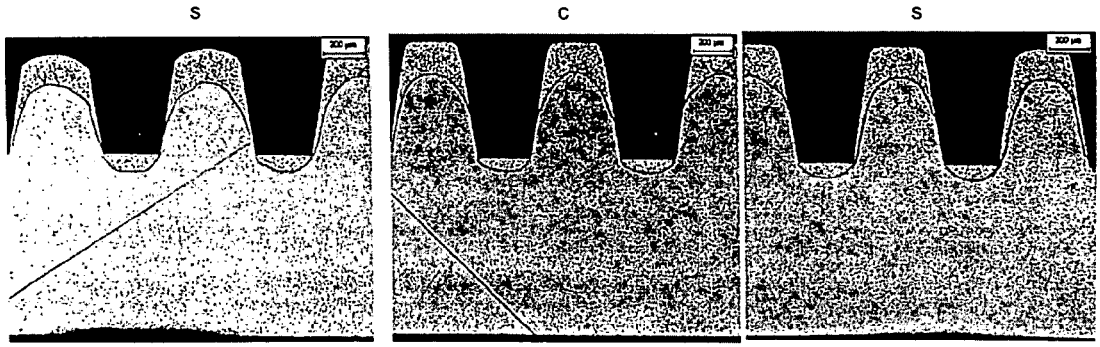
FIG. 14 shows enlarged cut images of rolled brazing sheets according to the third embodiment.

Another example of a brazing sheet rolled with the rough profile depicted on the left of FIG. 10 and the fine profile depicted on the right of FIG. 10 is shown in FIGS. 13 and 14, respectively. This brazing sheet had a core of M3003-type alloy and a 10% clad layer of an AA4045 aluminium alloy. Again, the roll produced a very regular shape of trapezoidal ridges, with the best results achieved in the centre of the roll. However, the profile at the sides of the roll was also good.

Figure 15A:
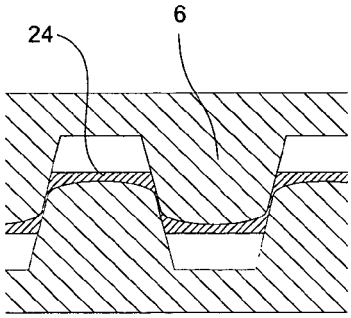
FIG. 15*a* and FIG. 15*b* show an enlarged cross-sectional view of a profile according to the first embodiment before (FIG. 15*a*) and after brazing (FIG. 15*b*).
Figure 15B:
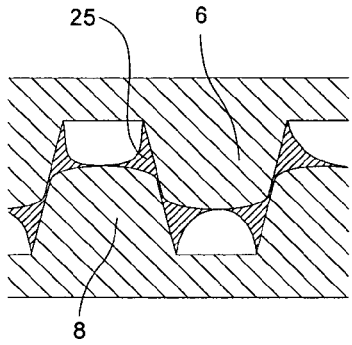

A schematic cross-sectional of a tube made from a rolled brazing sheet product is shown in FIG. 15 before (FIG. 15*a*) and after brazing (FIG. 15*b*). As shown by the examples, the clad layer 24 is pressed mainly to the top of the ridges and the bottom of the grooves during rolling. During brazing, the molten filler metal flows into the gaps between the ridges 6 and 8 and thereby forms fillets 25 at the contact points of the opposing ridges.

In principle all kinds of brazing technique may be used to braze the above-described tubes and the heat exchangers comprising such tubes.

One of the preferred techniques for brazing aluminium heat exchangers utilizes Nocolok® (registered trademark) flux. Nocolok® may be used with the present invention, too. However, spraying the heat exchanger with flux before brazing is a laborious and therefore expensive process. In case the profiles of the refrigerant tubes are to be brazed together, the Nocolok® process poses the problem of getting the flux inside the tubes. It is therefore more preferred to use one of the following fluxless brazing techniques.

In vacuum brazing, the parts to be brazed contain sufficient quantities of Mg as known in the art, such that, when heated in a brazing furnace under vacuum conditions, the Mg becomes sufficiently volatile to disrupt the oxide layer and permit the underlying aluminium filler metal to flow together. This brazing technique is especially suitable for the present invention, since Mg will accumulate inside the tube and will thus cause a better brazing result. The Mg content of the inner clad layer is preferably 0.2 to 1%, for example 0.6%.

Another fluxless brazing technique uses a thin nickel layer on top of the clad layer. Nickel reacts exothermally with the underlying aluminium alloy, thereby disrupting the oxide layer and permitting the filler metal to flow together and join. Instead of Ni, Co or Fe or alloys thereof may be used, for example as known from U.S. Pat. Nos. 6,379,818 and 6,391,476, and both incorporated herein by reference.

It is further contemplated to use polymer based brazing techniques. This method uses an additional polymer layer on top of the clad layer containing particles of flux material. The polymer layer acts as an adhesive layer to the clad layer. The polymer will evaporate in the heat-up cycle during brazing, leaving only the flux material on the metal surface, for example as known from U.S. Pat. No. 6,753,094, and incorporated herein by reference.

Having now fully described the invention, it will be apparent to one of ordinary skill in the art that many changes and modifications can be made without departing from the spirit or scope of the invention as hereon described.

The invention claimed is:

1. A tube made of a profile rolled metal product, the tube comprising a first wall and a second wall forming two opposing walls of said tube, and a plurality of reinforcing structures connecting the first wall and second wall and forming longitudinal passages for transporting fluid between the first wall and the second wall, wherein each reinforcing structure comprises a longitudinal ridge on the first wall projecting towards the second wall, and a longitudinal ridge on the second wall projecting towards the first wall, each ridge comprises a base, a top and two longitudinal sides, the ridges engaging each other at their sides, and the ridges on the first and/or the second walls have a profile selected from the group consisting of a trapezoidal, a rectangular, and a cone-shaped profile, wherein the ridges on the first and/or the second walls are broader at the base than at the top, and wherein each wall has a profile of the ridges spaced from each other such that a groove is formed between two neighboring ridges, opposed sides of the neighboring ridges forming sides of the groove, wherein the two sides of a respective said ridge engage the two sides of a respective said groove in the opposing wall, thereby forming a longitudinal passage in the groove, wherein the respective groove of each wall has a base defined by the respective wall between the neighboring ridges on the respective wall, and the two sides of the respective ridge engage the two sides of the respective groove in the opposing wall with the top of the respective ridge and the base of the respective groove being opposed and spaced to form a longitudinal passage in the groove as a space between the top of the respective ridge and the base of the respective groove.

2. A tube according to claim 1, wherein the ridges on the first and the second walls have the trapezoidal profile.

3. A tube according to claim 1, wherein the first wall has the same ridge profile as the second wall.

4. A tube according to claim 1, wherein the top of the respective ridge is broader than the base of the respective groove.

5. A tube according to claim 1, wherein the top of each ridge in one wall engages a recess in the other wall.

6. A tube according to claim 1, wherein the second wall has a profile of ridges forming grooves between two neighbouring ridges, wherein each ridge on the first wall engages a groove in the second wall.

7. A tube according to claim 1, wherein the first wall has a profile of main ridges having small ridges on top, the small ridges engaging the sides of corresponding small ridges in the second wall.

8. A tube according to claim 1, wherein each ridge on the first and/or second wall includes a plurality of cut-outs forming communication holes for causing neighbouring longitudinal passages to communicate with one another.

9. A tube according to claim 1, wherein the ridges on the first and second walls are joined to each other by one or more of friction welding, resistance welding, or brazing.

10. A tube according to claim 1, wherein the profile rolled metal product is made from a brazing sheet product comprising an aluminium alloy on one or both sides clad with a brazing filler material.

11. A tube according to claim 1, wherein the profile rolled metal product is made from a brazing sheet product comprising an aluminium alloy on one or both sides clad with a brazing filler material, and wherein each clad layer has a thickness of 2 to 13% of the total thickness of the brazing sheet product.

12. A tube according to claim 1, the tube having a width of up to 100 mm and a height of up to 10 mm.

13. A tube according to claim 1, wherein the first wall and the second wall are joined to each other by means of brazing.

14. A tube according to claim 1, wherein the tube is of a heat exchanger device.

15. A rolled metal product for producing the first and/or second wall of the tube of any claim 1, wherein it has a profile as described in claim 1 and is produced by rolling a brazing sheet clad at least on one side with a brazing material.

16. A tube made of a profile rolled metal product, the tube comprising a first wall and a second wall forming two opposing walls of said tube, and a plurality of reinforcing structures connecting the first and second walls and forming longitudinal passages for transporting fluid between the first wall and the second wall, wherein each reinforcing structure comprises a longitudinal ridge on the first wall projecting towards the second wall, and a longitudinal ridge on the second wall projecting towards the first wall, each ridge comprises a base, a top and two longitudinal sides, the ridges engaging each other at their sides, and the ridges on the first and/or the second walls have a profile selected from the group consisting of a trapezoidal profile with rounded edges at the top, wherein the ridges on the first and/or the second walls are broader at the base than at the top, and wherein each wall has a profile of the ridges spaced from each other such that a groove is formed between two neighboring ridges, opposed sides of the neighboring ridges forming sides of the groove, wherein the two sides of a respective said ridge engage the two sides of a respective said groove in the opposing wall, thereby forming a longitudinal passage in the groove, wherein the respective groove of each wall has a base defined by the respective wall between the neighboring ridges on the respective wall, and the two sides of the respective ridge engage the two sides of the respective groove in the opposing wall with the top of the respective ridge and the base of the respective groove being opposed and spaced to form a longitudinal passage in the groove as a space between the top of the respective ridge and the base of the respective groove.

17. A method for producing a tube comprising a first wall and a second wall forming two opposing walls of said tube, and a plurality of reinforcing structures connecting the first and second walls and forming longitudinal passages for transporting fluid between the first wall and the second wall, wherein each reinforcing structure comprises a longitudinal ridge on the first wall projecting towards the second wall, and a longitudinal ridge on the second wall projecting towards the first wall, each ridge comprises a base, a top and two longitudinal sides, the ridges engaging each other at their sides, and the ridges on the first and/or the second walls have a profile selected from the group comprising trapezoidal, a rectangular, and a cone-shaped profile, wherein the ridges on the first and/or the second walls are broader at the base than at the top, and wherein each wall has a profile of the ridges spaced from each other such that a groove is formed between two neighboring ridges, opposed sides of the neighboring ridges forming sides of the groove, wherein the two sides of a respective said ridge engage the two sides of a respective said groove in the opposing wall, thereby forming a longitudinal passage in the groove, wherein the respective groove of each wall has a base defined by the respective wall between the neighboring ridges on the respective wall, and the two sides of the respective ridge engage the two sides of the respective groove in the opposing wall with the top of the respective ridge and the base of the respective groove being opposed and spaced to form a longitudinal passage in the groove as a space between the top of the respective ridge and the base of the respective groove, comprising the steps of producing the first and the second wall by rolling a metal sheet clad at least on one side with a brazing material with a pair of rolls, one of the rolls having parallel annular grooves for forming ridges on one side of the sheet, placing the first wall on top of the second wall, connecting the first and second walls by clamping or rolling.

18. The method according to claim 17, wherein the first and second walls are clamped together by forming a flange on one of the walls holding the other wall.

19. The method according to claim 17, wherein the first and second walls are joined together by rolling, thereby causing a frictional connection and/or a friction welded connection between the sides of the ridges engaging each other.

20. A method for producing a heat exchanger comprising:

providing a pair of headers, a plurality of refrigerant tubes joined at each end to one of the headers, and corrugated fins disposed between adjacent refrigerant tubes, the refrigerant tubes comprising a first wall and a second wall forming two opposing walls of said tube, and a plurality of reinforcing structures connecting the first wall and second wall and forming longitudinal passages for transporting fluid between the first wall and the second wall, wherein each reinforcing structure comprises a longitudinal ridge on the first wall projecting towards the second wall, and a longitudinal ridge on the second wall projecting towards the first wall, each ridge comprises a base, a top and two longitudinal sides, the ridges engaging each other at their sides, and the ridges on the first and/or the second walls have a profile selected from the group comprising trapezoidal, a rectangular, and a cone-shaped profile, wherein the ridges on the first and/or the second walls are broader at the base than at the top, and wherein each wall has a profile of the ridges spaced from each other such that a groove is formed between two neighboring ridges, opposed sides of the neighboring ridges forming sides of the groove, wherein the two sides of a respective said ridge engage the two sides of a respective said groove in the opposing wall, thereby forming a longitudinal passage in the groove, wherein the respective groove of each wall has a base defined by the respective wall between the neighboring ridges on the respective wall, and the two sides of the respective ridge engage the two sides of the respective groove in the opposing wall with the top of the respective ridge and the base of the respective groove being opposed and spaced to form a longitudinal passage in the groove as a space between the top of the respective ridge and the base of the respective groove, assembling the headers, the refrigerant tubes, and the corrugated fins, brazing the heat exchanger assembly.

21. The method of claim 20, wherein the tubes are made from an aluminium sheet clad on at least the profiled side with a brazing material, and the first and second walls are brazed together during brazing of the heat exchanger assembly.

22. The method according to claim 20, wherein brazing the heat exchanger assembly is by means of vacuum brazing or by fluxless brazing.

* * * * *